US006513824B2

(12) United States Patent
DuBose

(10) Patent No.: US 6,513,824 B2
(45) Date of Patent: Feb. 4, 2003

(54) COMBINATION LIFT MECHANISM AND WHEELCHAIR

(75) Inventor: Steven C. DuBose, 2000 Indian Trail, Trailer 13B, Harker Heights, TX (US) 76548

(73) Assignee: Steven C. DuBose, Harker Heights, TX (US)

( * ) Notice: Subject to any disclaimer, the term of this patent is extended or adjusted under 35 U.S.C. 154(b) by 0 days.

(21) Appl. No.: 09/681,864

(22) Filed: Jun. 19, 2001

(65) Prior Publication Data

US 2002/0000706 A1 Jan. 3, 2002

Related U.S. Application Data

(60) Provisional application No. 60/214,807, filed on Jun. 28, 2000.

(51) Int. Cl.[7] ..... A47C 31/00

(52) U.S. Cl. ..... 280/304.1; 280/304.3; 297/DIG. 10; 297/465

(58) Field of Search ..... 280/304.1, 304.3, 280/304.4, 304.5, 290; 297/DIG. 10, 465, 464, 452.25; 5/89.1, 83.1

(56) References Cited

U.S. PATENT DOCUMENTS

| | | | | |
|---|---|---|---|---|
| 3,137,011 A | * | 6/1964 | Fischer | 5/86 |
| 3,252,704 A | | 5/1966 | Wilson | |
| 3,640,571 A | * | 2/1972 | Keropian | 297/384 |
| 4,073,537 A | * | 2/1978 | Hammersburg | 297/384 |
| 4,159,010 A | | 6/1979 | Mitro | |
| 4,530,122 A | | 7/1985 | Sanders et al. | |
| 4,682,377 A | | 7/1987 | Reich | |
| 4,691,762 A | * | 9/1987 | Elkins et al. | 165/46 |
| 4,739,526 A | | 4/1988 | Hollick | |
| 4,796,948 A | | 1/1989 | Paul et al. | |
| 4,903,355 A | | 2/1990 | Hickerson | |
| 4,972,351 A | | 11/1990 | Reger et al. | |
| 4,981,307 A | * | 1/1991 | Walsh | 280/290 |
| 5,165,123 A | * | 11/1992 | Colpron | 5/83.1 |
| 5,333,333 A | * | 8/1994 | Mah | 5/81.1 |
| 5,546,313 A | | 8/1996 | Masters | |
| 6,178,562 B1 | * | 1/2001 | Elkins | 2/458 |
| 6,213,558 B1 | * | 4/2001 | Axelson et al. | 297/464 |

FOREIGN PATENT DOCUMENTS

| | | |
|---|---|---|
| CA | 1046202 | 1/1979 |
| EP | 0 000 443 A1 | 7/1978 |
| WO | WO 94/15569 | 7/1997 |

* cited by examiner

*Primary Examiner*—Kevin Hurley
*Assistant Examiner*—Tony Winner
(74) *Attorney, Agent, or Firm*—Taylor Russell & Russell, P.C.

(57) ABSTRACT

A combination lift mechanism and wheelchair which is used to lift a user confined to a wheelchair above the seat of the wheelchair for providing relief and healing from bedsores on the user's lower back and buttocks. A vest is mounted on first and second arm portions of the wheelchair as pivotal first and second assemblies. The user is secured to the vest having hinges and buckle fasteners disposed on the front and back of the lifting vest. Fluid conduits are also disposed within the vest for regulating peripheral body temperature of the user. An actuating mechanism is mounted within first and second support assemblies for selectively lifting or lowering a user a predetermined height for providing circulation, relief and healing from bedsores.

15 Claims, 10 Drawing Sheets

COMBINATION LIFT MECHANISM AND WHEELCHAIR

CROSS REFERENCE TO RELATED APPLICATIONS

REFERENCED-APPLICATIONS

This application claims the benefit of U.S. Provisional Application No. 60/214,807, filed Jun. 28, 2000.

BACKGROUND OF INVENTION

The present invention relates generally to wheelchairs. More specifically, the invention is a combination temperature controlled lift mechanism and wheelchair for lifting a non-ambulatory user confined to a wheelchair to provide relief and healing from bedsores.

Non-ambulatory persons confined to a wheelchair often suffer from pressure induced ulcerations of the skin, better known as bedsores. These bedsore contact points are typically on the lower portion of the back, the buttocks and the back of the thighs. Bedsores can be very serious because the subsurface muscles, as well as the surface sores, may become infected.

The related art addresses this problem by suggesting the use of a harness or sling to lift a wheelchair-bound patient to relieve pressure on these bedsores. Unfortunately, these harnesses or slings generally support the patient at bedsore contact points so that such devices would not be useful in relieving the body pressure on the contact points at which bedsores occur. This problem is addressed in U.S. Pat. No. 4,530,122, issued to Sanders, et al., that discloses a patient weight reliever apparatus that utilizes a sling designed to support the patient at places other than the patient's normal bedsore contact points. Also, this device has been known to be somewhat unstable, especially when the patient rests within or rises from the chair. The long back bar used has the tendency to produce rotations about the axle of the wheelchair which further contributes to its instability.

U.S. Pat. No. 4,981,307, issued to Walsh, discloses a suspension harness and body jacket that reduces pressure applied to a patient's buttocks while suspending the patient above a wheelchair via springs. This device has similar rotational instabilities, and the spring constant required for suspending a patient has tendency to loose its stiffness or elasticity over time. Although each of these devices can help the healing of bedsores and to reduce the formation of bedsores, they can be considered as flimsy or unstable, especially for larger wheelchair patients. These devices can also bind-up a person and be uncomfortable. What is needed is a more stable device that can accommodate a wheelchair-bound patient that is more durable and comfortable than the two previously described devices.

U.S. Pat. No. 4,796,948, issued to Paul, et al., discloses a patient support system for wheelchairs comprising an inflatable support element. The inflatable support element is located to receive the ischial tuberosities thereover and is normally deflated whereby minimal pressures are generated on body areas thereover. A fluid support retaining element is also incorporated into the seat portion for supporting a percentage of body weight thereon.

Other patents which are of general relevance to the lifting device as herein described are those respectively issued and granted to Wilson (U.S. Pat. No. 3,252,704), Mitro (U.S. Pat. No. 4,159,010 and CA 1046202), Reich (U.S. Pat. No. 4,682,377), Hollick (U.S. Pat. No. 4,739,526), Hickerson (U.S. Pat. No. 4,903,355), Mikkonen, et al. (WO 94 /15569) and Clark, et al. (EPO 0000443). The particular features, described in these patents are directed to lifting harnesses mounted and operatively lifted via mechanically activated booms which suspends a patient in mid-air.

U.S. Patant issued to Roger, et al. (U.S. Pat. No. 4,972,351) and Masters (U.S. Pat. No. 5,546,313) disclose certain computer generated techniques for manufacturing articles such as seat elements in particular from pin elements. These devices can be subsequently produced via molds or injection molding processes.

None of the above inventions and patents, taken either singly or in combination, is seen to describe the instant invention as claimed.

SUMMARY OF INVENTION

The lifting device according to the invention lifts an individual confined to a wheelchair, above the seat of the wheelchair, to provide relief and healing from bedsores on an individual's lower back and buttocks. The device includes a custom made vest which is pivotally mounted and secured thereto. The lifting device is adapted for attachment as a fixed or removable system to a wheelchair via first and second pivotal assemblies. An elliptical cam-lever is mounted within each pivotal assembly for selectively raising and lowering a user secured thereto. A user is secured via the vest by buckle fasteners and hinges from the front and back of the lifting vest. The user is selectively raised assisted or unassisted, thereby providing temporary relief and healing from bedsores. The vest is temperature controlled via hydraulic conduits disposed in and around the vest to reduce temperature gradients or moisture related skin irritations at contact points along for the user. The cam-lever can be manipulated manually or can be adapted as an automated lifting feature, using hydraulic, pneumatic or electrical mechanisms that are well-known in the art.

Accordingly, it is a principal object of the invention to provide a combination lifting device and wheelchair that can lift an individual sitting therein for providing relief from bedsores.

It is another object of the invention to provide a combination lifting device and wheelchair having a vest which can regulate the peripheral body temperature of a user to prevent moisture related skin irritations.

It is a further object of the invention to provide a combination lifting device and wheelchair which includes the use of a cam-lever for selectively raising and lowering a user a predetermined height or distance from a wheelchair.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF DRAWINGS

Similar reference characters denote corresponding features consistently throughout the attached drawings.

DETAILED DESCRIPTION

The present invention is directed to a combination lift mechanism and wheelchair for non-ambulatory persons I. The preferred embodiment of the present invention is depicted in FIGS. 1, 2A, 3A, 3B and 4A and is generally referenced by numeral 10. Alternative embodiments of the present invention are depicted in FIG. 3E.

Figure 1:
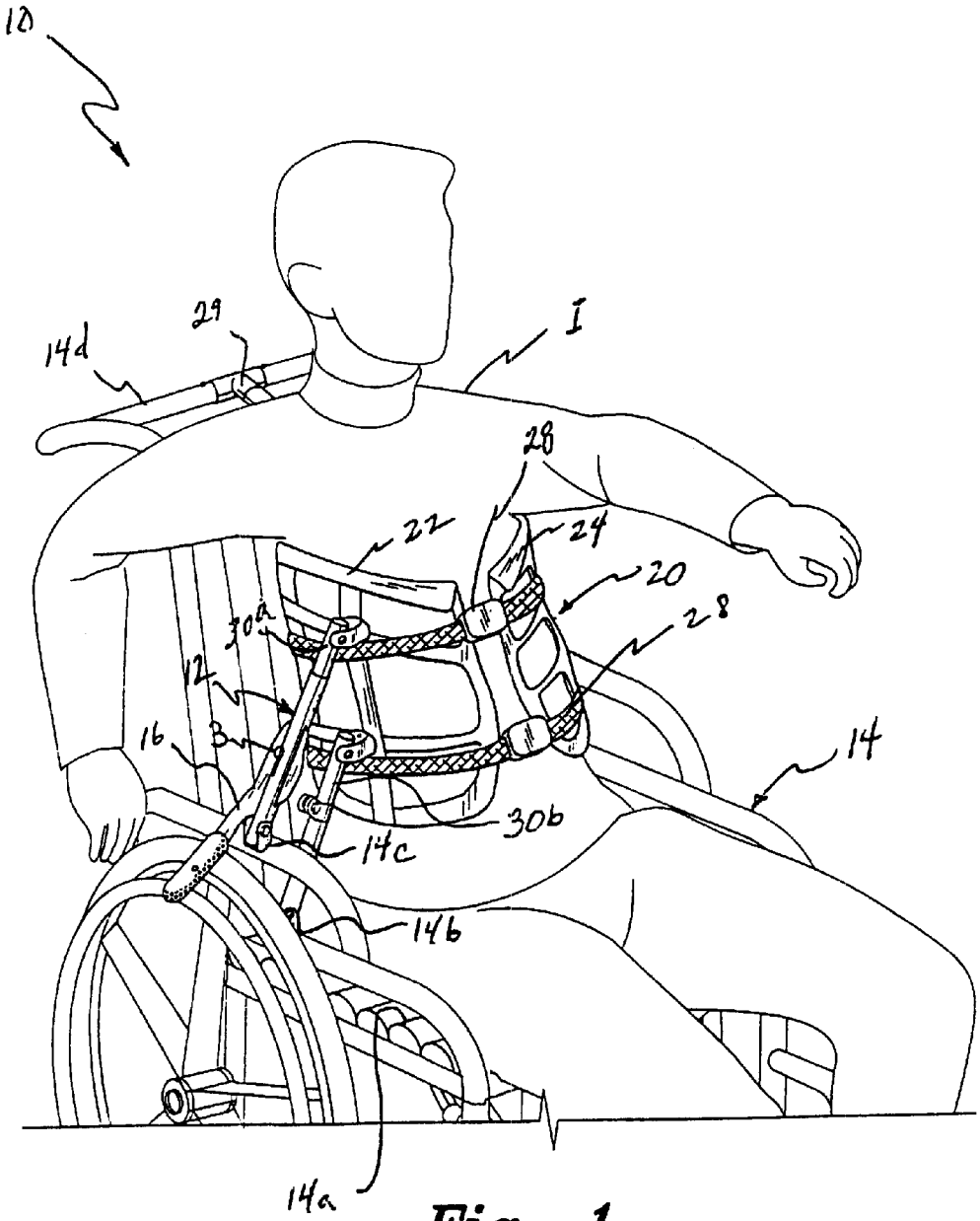
FIG. 1 is an environmental, perspective view of a combination lift mechanism and wheelchair for lifting a user in a wheelchair according to the present invention.

As diagrammatically illustrated in FIG. 1, a non-ambulatory person or user I is shown secured to the lift mechanism 12 which is pivotally and fixedly mounted to a wheelchair 14 via mechanical welds, U-shaped brackets and fasteners at handrail locations 14*b*, 14*c*. The wheelchair 14 is also configured with an ergonomically designed seat cushion 14*a* which serves to support a proper sitting posture and enhances blood circulation in the lower extremities of the user I.

The lift mechanism 12 of the lifting device 10 comprises a vest 20 with a first half section 22 and a second half section 24, a set of supporting arms 30*a* and 30*b* (for both left and right handrails of the wheelchair 14) attaching each half section 22, 24 of the vest 20 to the wheelchair 14 at first 14*b* and second 14*c* handrail locations on each side of the wheelchair 14. This particular arrangement is a symmetrically arranged attachment on both left and right handrail sides of the wheelchair 14, respectively. As illustrated in FIG. 1, mechanical nut and bolt fasteners are used in combination with U-shaped brackets (see FIG. 3A, 22*a* and 22*b* ) for pivotally securing each respective supporting arm 30*a* and 30*b* to each respective handrail side at handrail locations 14*b*, 14*c*. The lifting means or cam-lever 16 is pivotally disposed within a base portion of the support arm 30*a* via pivot pin or bolt 3 and is used to selectively raise and lower a user I secured in the vest 20.

When the cam-lever 16 is pivotally rotated and positioned from substantially perpendicular to parallel with respect to the lifting arms 30*a* and 30*b*, a lifting force is generated which urges the lifting bars upward, thereby providing a sufficient upward force through the structure of the vest 20 via the support arms 30*a*, 30*b* which telescope outward such that the user I is lifted at least three inches from the seat 14*a*. The elliptical shape of the cam-lever having a predetermined set of foci to extent the movable support arms 30*a*, respectively a predetermined height h (see FIG. 4A), such that a user's lower back and buttocks are relieved from pressure which hinders good blood circulation and which contributes to the development of bedsores. The telescoping members 30*a*, 30*b* are pivotally secured to each respective side 22, 24 of the vest 20 via substantially U-shaped elements 22*a*, 22*b* ( 24*a* and 24*b* for the right side not shown in FIG. 3A) which are integrally secured to each vest element via a custom manufacturing procedure utilizing either computer numerical machining techniques, castings or molds. The vest can be manufactured as a solid or skeletal structure with material reinforcements 22*c* (i.e., lightweight metal material) to provide sufficient support in areas which minimize stress points around the chest cavity of a user I and to minimize overall inertia. However, this is accomplished without compromising the structural integrity of the vest material to withstand dynamical and static forces which contribute to cyclical or material fatigue.

Figure 3A:
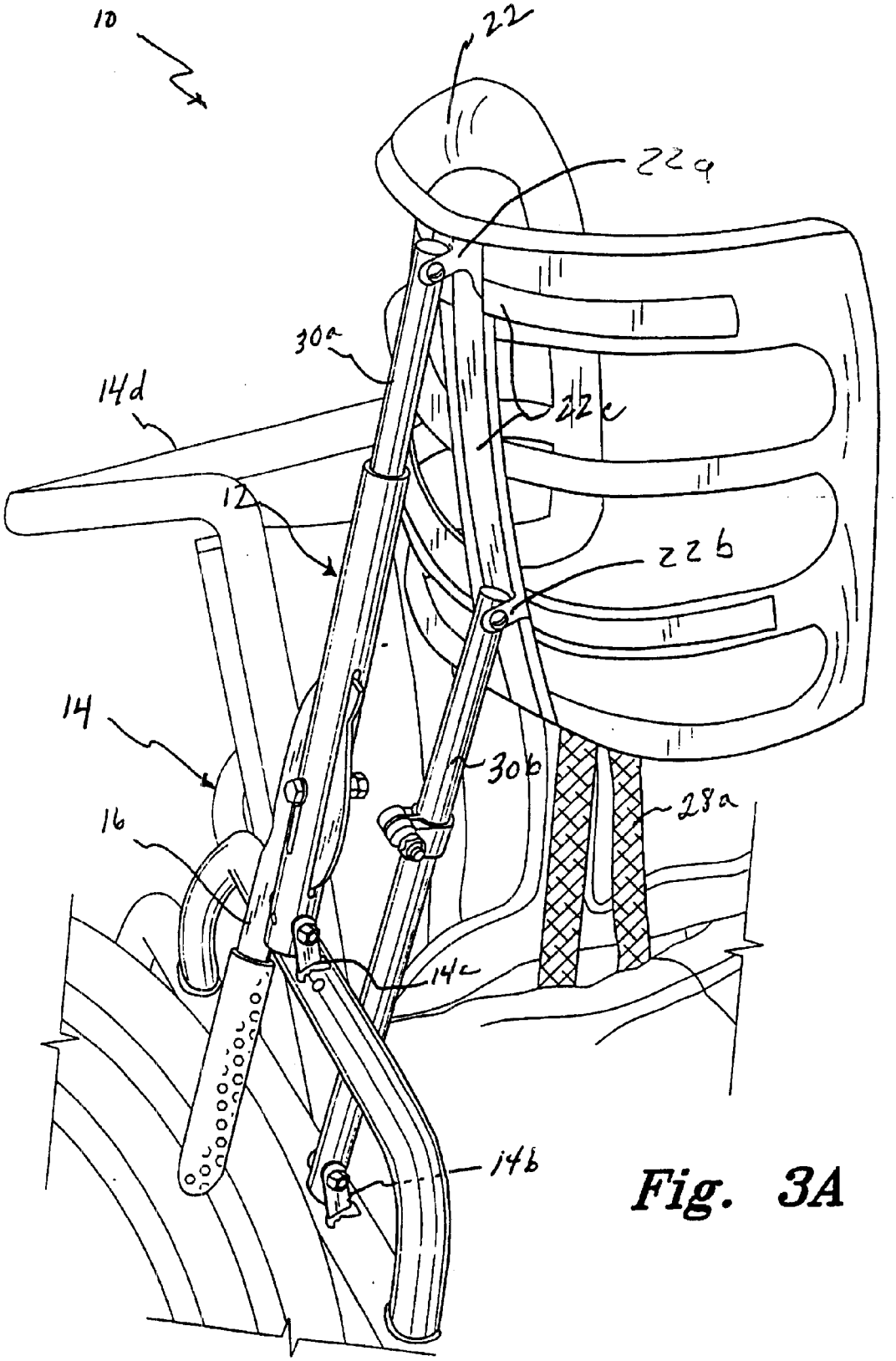
FIG. 3A is a partial perspective side view of the combination lift mechanism and wheelchair, illustrating an adjustable lever-cam used in the present invention.
Figure 3B:
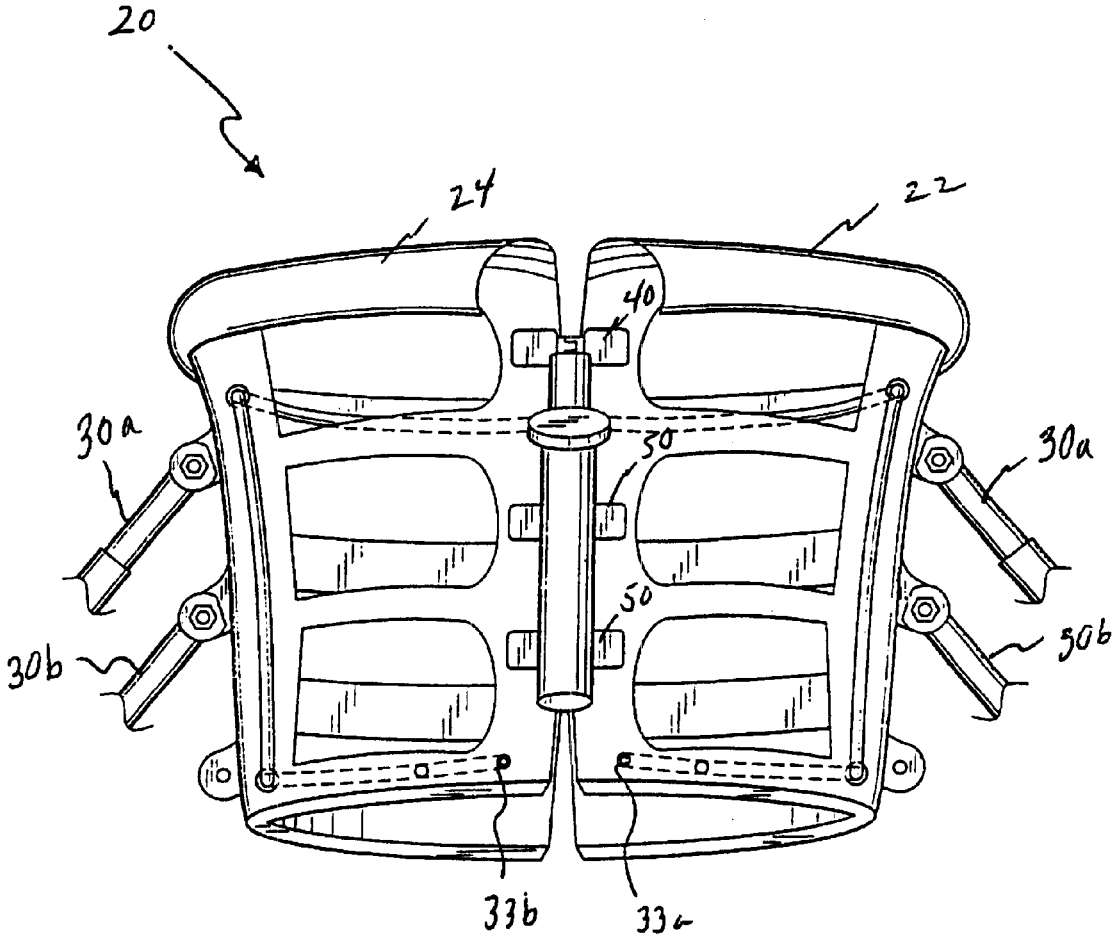
FIG. 3B is a perspective rear view of the temperature controlled vest used according to the invention.
Figure 3C:
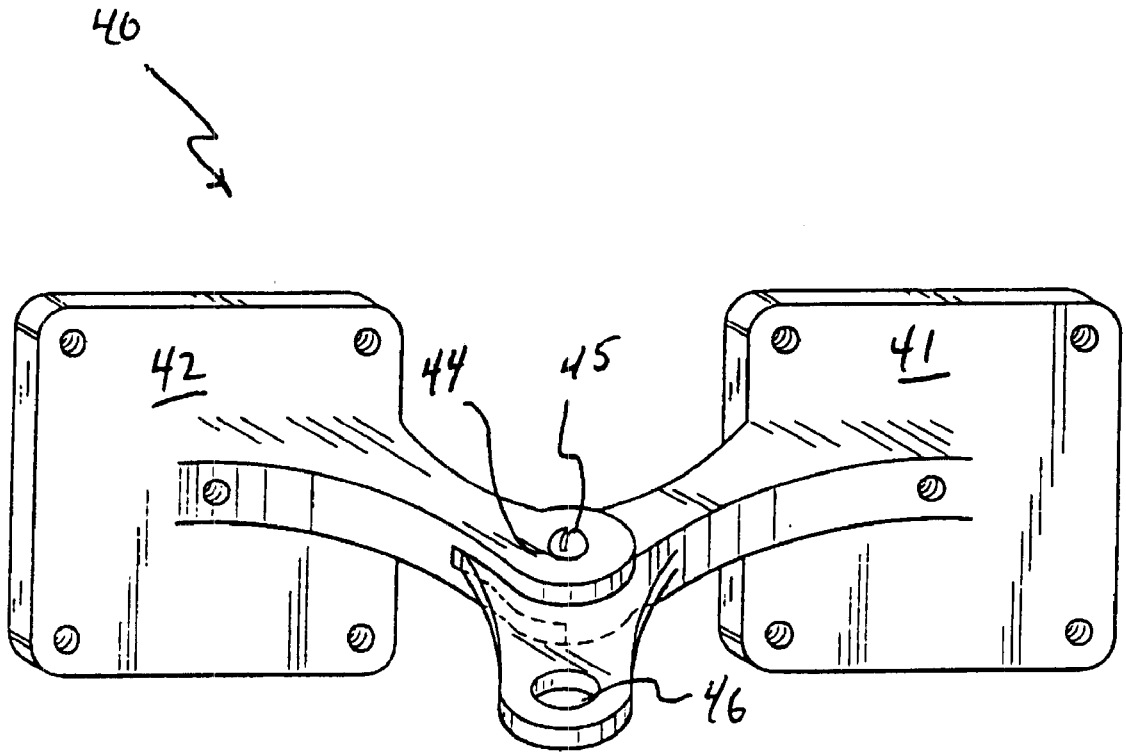
FIG. 3C is a perspective view of a middle and bottom hinge element used according to a first embodiment of the invention.
Figure 3D:
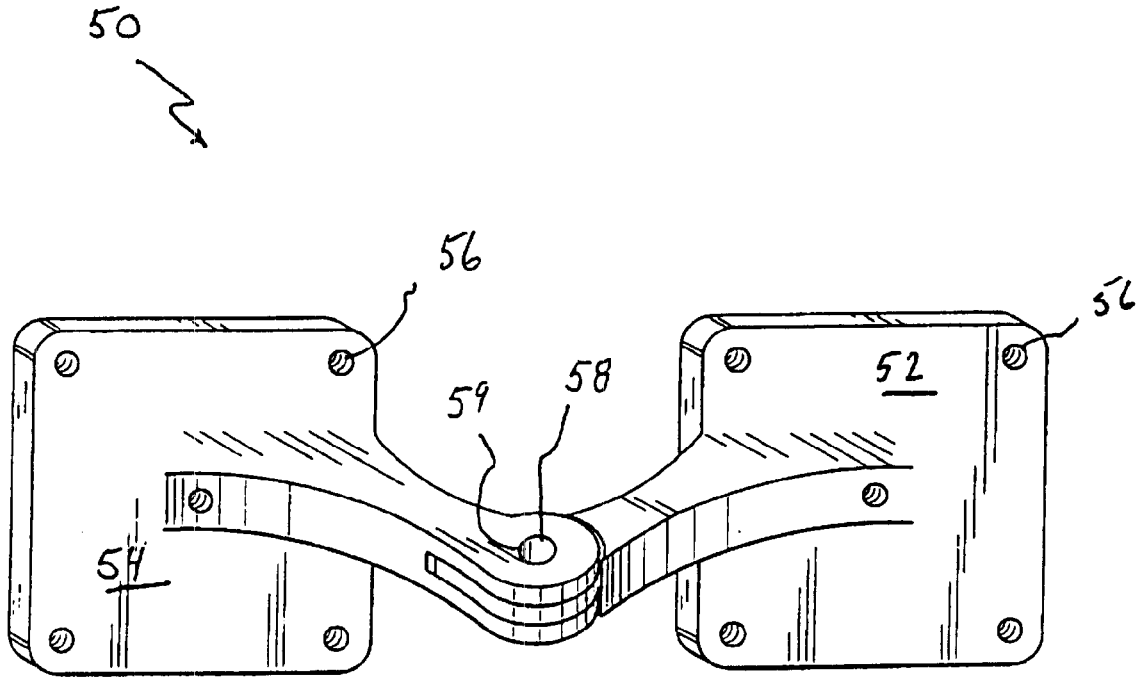
FIG. 3D is a perspective view of a middle and bottom hinge element used according to a second embodiment of the invention.
Figure 3E:
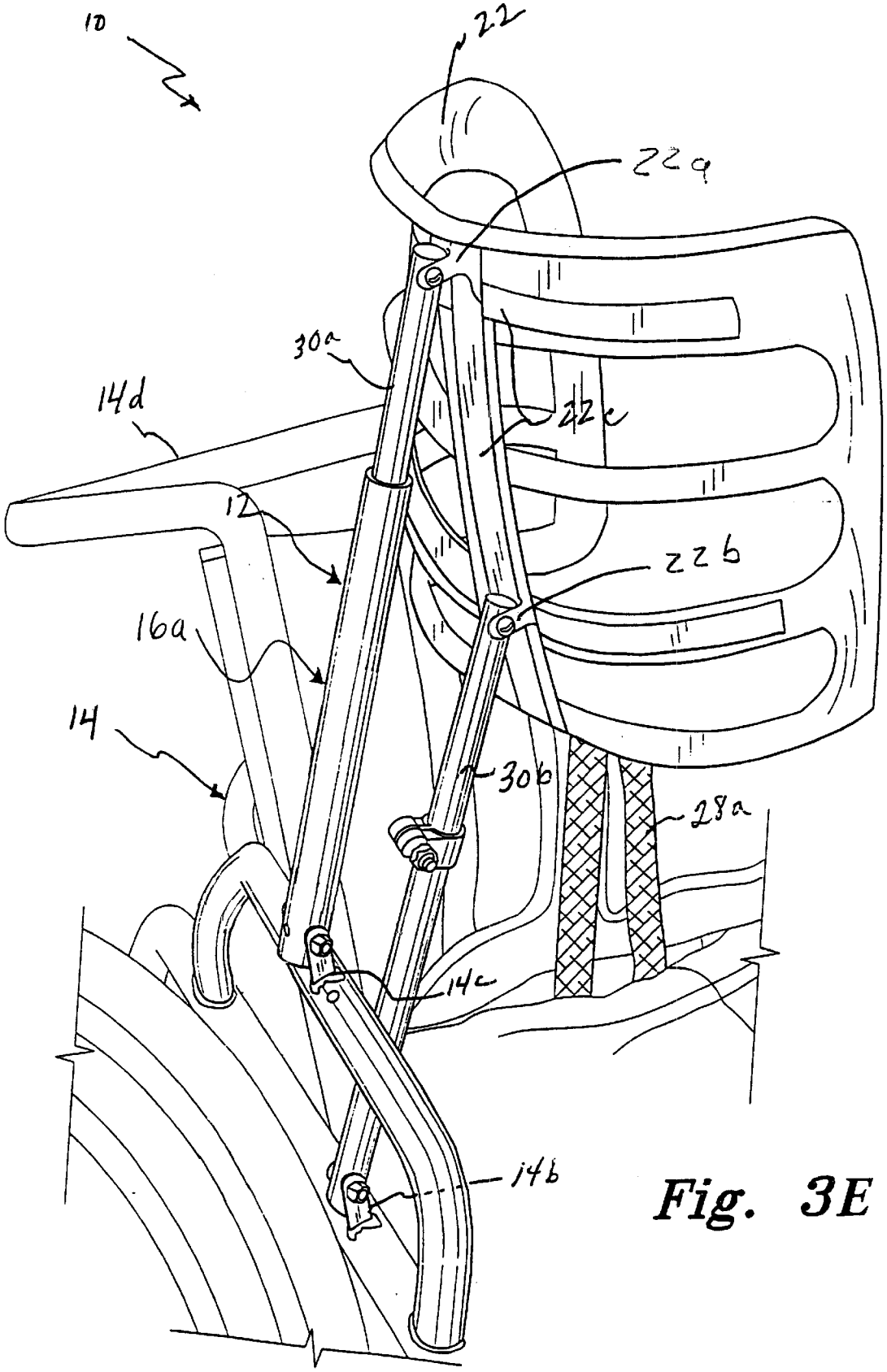
FIG. 3E is a partial perspective side view of the combination lift mechanism and wheelchair, illustrating a hydraulic, pneumatic or electrical mechanism used in an embodiment of the present invention.

FIG. 3E is an alternate depiction of FIG. 3A where the cam-lever 16 is replaced by a hydraulic, pneumatic or electrical mechanism 16*a* that relies on power from a pump and/or a battery mounted beneath the wheelchair seat 14*a*. Interchangeable hydraulic, pneumatic and electrical actuators depicted as 16*a,* as well as switching means for initiating actuation, are well known in the relevant art. The raised position of the lift mechanism 12 is shown in the partial view in FIG. 3E.

Figure 2A:
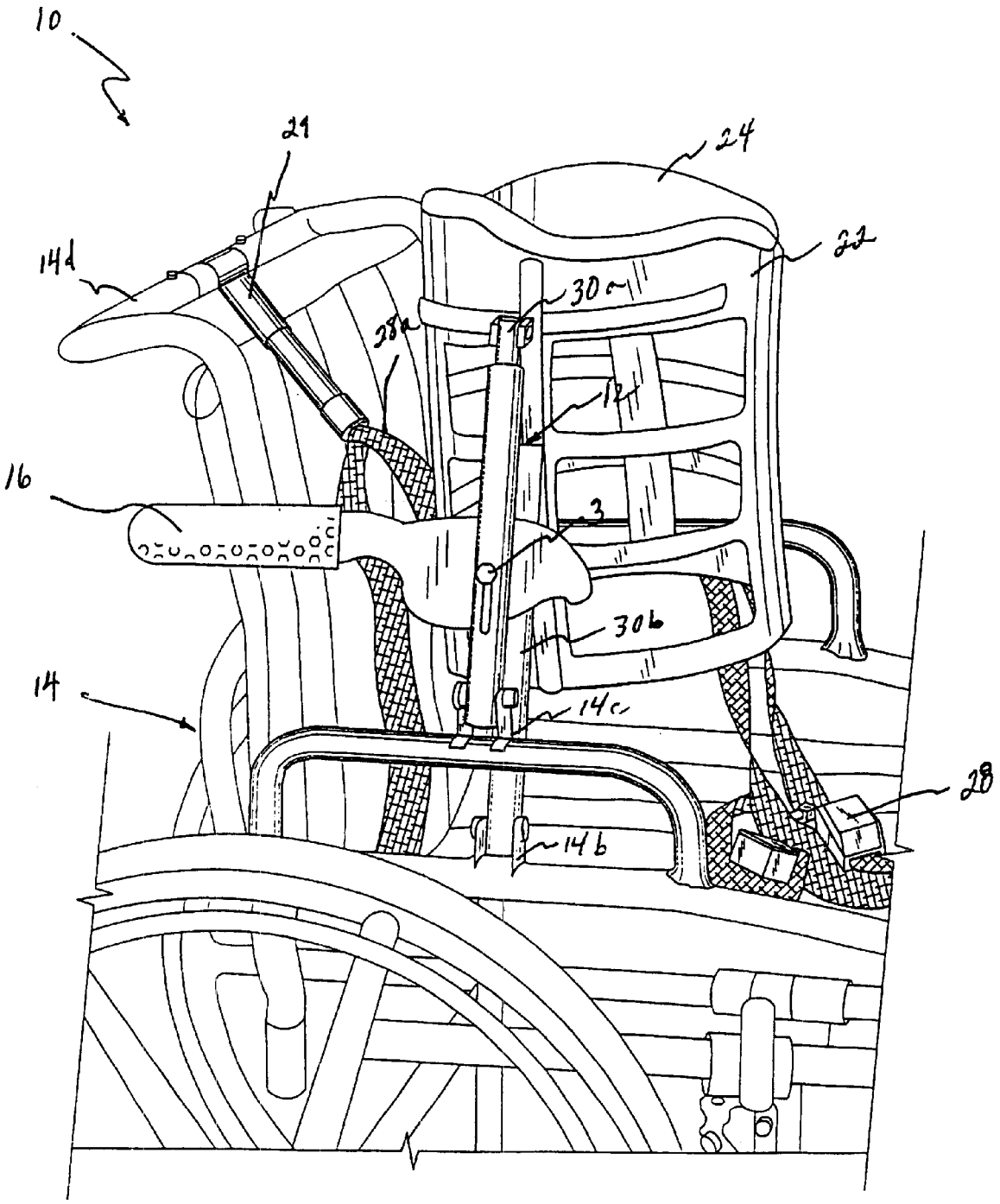
FIG. 2A is a perspective side view of the combination lift mechanism and wheelchair, illustrating the cam-lever element for selectively lifting and lowering a user according to the invention.
Figure 2B:
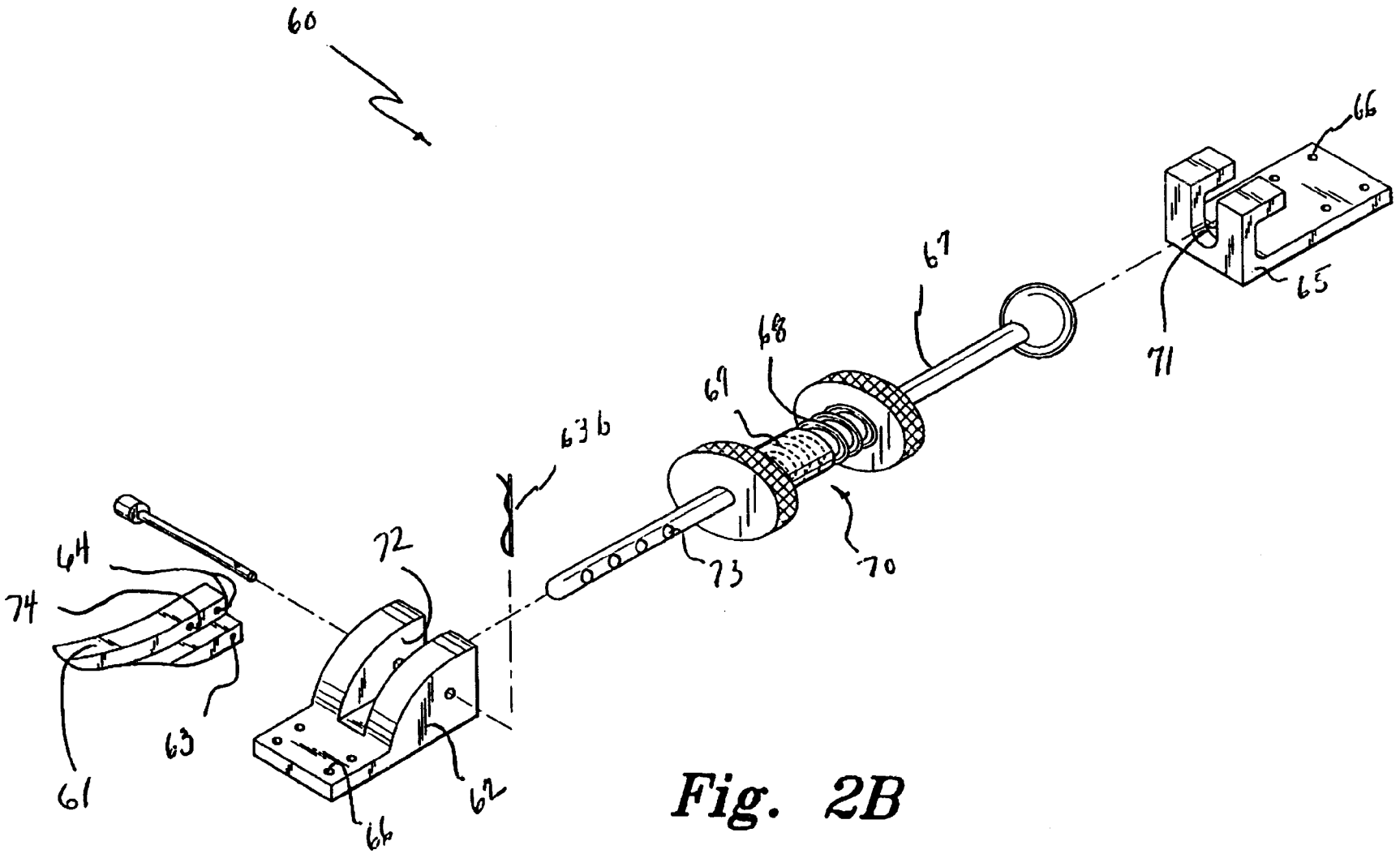
FIG. 2B is a perspective view of a buckle attachment mechanism used to attach the end of the supporting arms of the invention with a horizontal support of a wheelchair.

A variety of different hinge mechanisms can be used with the custom made vest 20 to operatively close and open the vest as a removable vest feature, but such hinge mechanisms should be made as an integral feature which provides the attributes of a living hinge to facilitate simple attachment of the vest to the users with reduced weight requirements. (See FIGS. 3B, 3C and 3D). Other secure features of the vest may include the use of a plurality of clasps 60 diagrammatically illustrated in FIGS. 2B and 4A. As shown therein three clasps 60 which serve as a securing means that secures the front of the vest 20. There is a buckle 61 for each clasp 60 that is attached to a base 62 through holes 63 and 64 by two metal pins 63*a* (including fasteners 63*b*) which are selectively sized for attachment therein. There is a second base 65 that is horizontal to the first base 62, with both bases 62, 65 attached to the vest 20 using tapered, flathead screws 66 mounted from inside the vest 20. A stainless steel pin 67 is inserted through a threaded male portion 68 and female portion 69 adjusting knob assembly 70.

The ends of the stainless steel pin 67 are placed in each channel 71, 72 of each base 62, 65 with the adjusting knob assembly 70 being between the two bases 62, 65. The buckle 61 is then attached to the end of the stainless steel pin 67 with a metal pin (not shown) through hole 74 of the buckle 61 and through hole 73 of the stainless steel pin 67. The adjustable front fasteners 60 are engaged and released by moving the buckle 61 across the adjustable front fastener 60 and can be adjusted by manipulating the adjusting knob assembly 70. Even with this feature, again, the cam-lever 16 is integral with the vest 20 and adjusts the height of the vest 20 between two nylon stops (not shown), each disposed within the base of the support arms 30*a* and at the base of the bar which surrounds bars 30*a*, and is hingedly connected at 14*c*. By turning the lever 16 upwards or downwards, which changes the distance between the two nylon stops and changes the length of the arms 30*a*, respectively, this results in lifting or lowering the vest 20 and user I together. There are two positions or settings for each cam-lever 16, which are approximately three inches apart. This is enough space to secure the user I above the wheelchair 14 to allow relief and healing from the bedsores which develop on the user's I buttocks and lower back.

As diagrammatically illustrated in FIG. 3B, the custom vest 20 is shown configured with hinge type fasteners 40, 50 and with fluid channels 33 for supplying a temperature controlled fluid therethrough. A pump system adapted for supplying a temperature controlled fluid such as warm or cold water therethrough via influent and effluent apertures 33*a* and 33*b* can be mounted and operated at the base of the wheelchair 14 as an automated feature. This fluid would serve to control the peripheral body temperature of the user I. As further illustrated in FIG. 3B, there is a top hinge 40 and two additional hinges 50, which are the securing means that secures the back of the vest 20. These hinges 40, 50 are permanent, as opposed to the adjustable front fasteners 28, 60 at the front of the vest 20, which can be opened or adjusted. The buckle fasteners are preferred as quick release fasteners, but if a more secure vest support is required the adjustable front fasteners 60 are preferred.

The top hinge 40 as depicted in FIG. 3C has a left half 41 and a right half 42. Both halves are attached to the vest 20 with tapered flathead mounting screws 43 from the inside of the vest 20. A pivoting bolt 44 holds the two halves together in a bolt aperture 45, which is also provided with a steel bushing. A second perpendicular bolt aperture 46 is provided to accommodate attaching a support bar 80 (see FIGS. 4A and 4B).

The middle and bottom hinges 50 are identical and are depicted in FIG. 3D. The hinges 50 have a left half 52 and a right half 54 and are also attached to the vest 20 with tapered flathead mounting screws 56 from the inside of the vest 20. A pivoting bolt 58 and bolt aperture with a steel bushing 59 holds the two halves together. The hinges 50 are also curved outward to clear any clothing worn by a user I while in the vest 20.

Figure 4A:
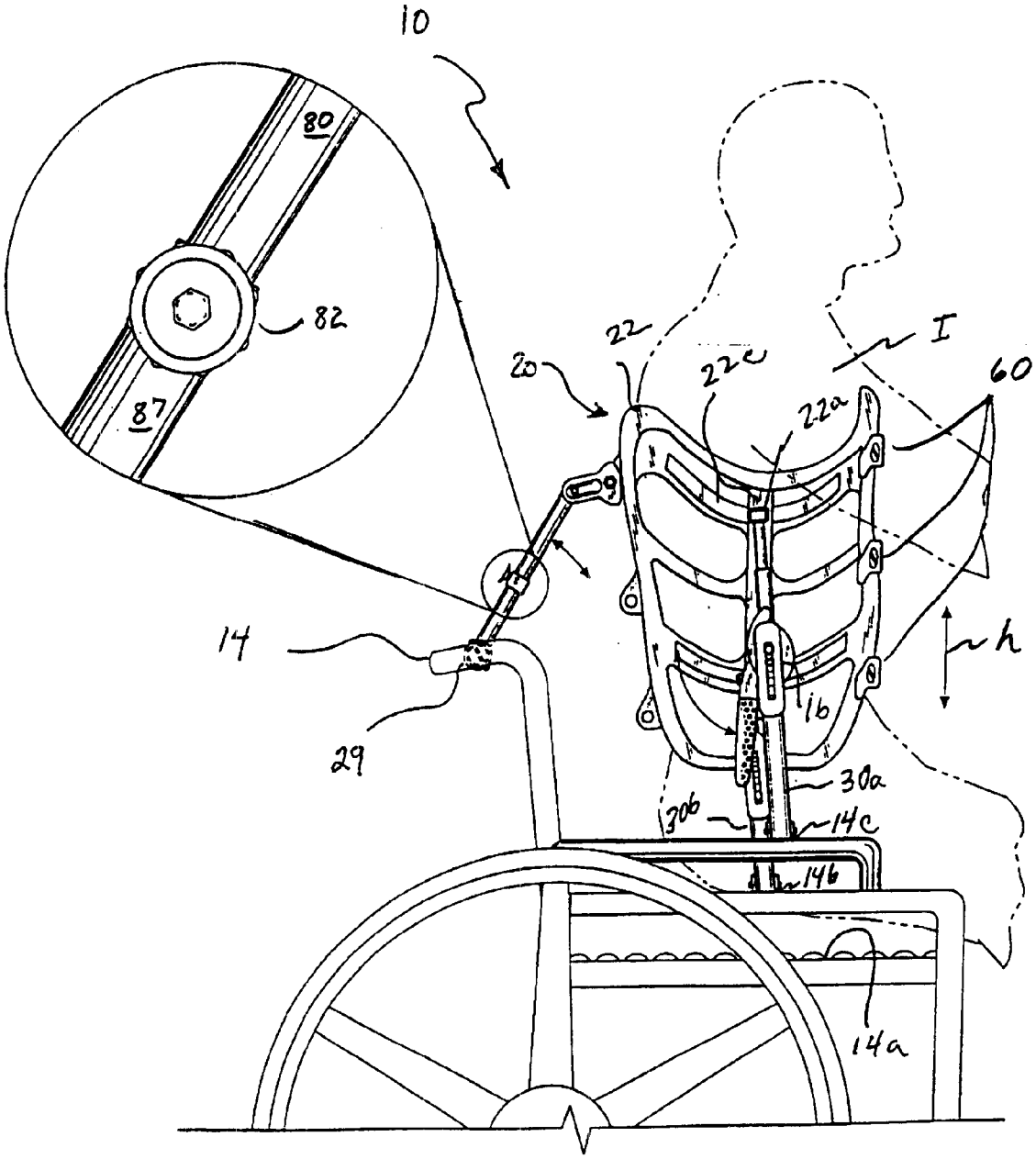
FIG. 4A is a side perspective view of the combination lift mechanism and wheelchair, illustrating a back support structure according to the invention.

FIG. 4A depicts the lifting device 10 used in combination with alternate back support bar assembly 82 for the wheelchair 14. A support bar 80 extends from the back of the top hinge 40 and slides up and down into a slightly wider section of tubing 87 on the wheelchair 14. The support bar 80, like the arms 30*a* of the lifting device 10, are preferably made of aluminum tubing. An optional canvas buttocks support (not shown) can be attached to the bottom of the vest 20 via snap-type fasteners. Such features are considered to be well within the knowledge of one having ordinary skill in the relevant art to provide.

Figure 4B:
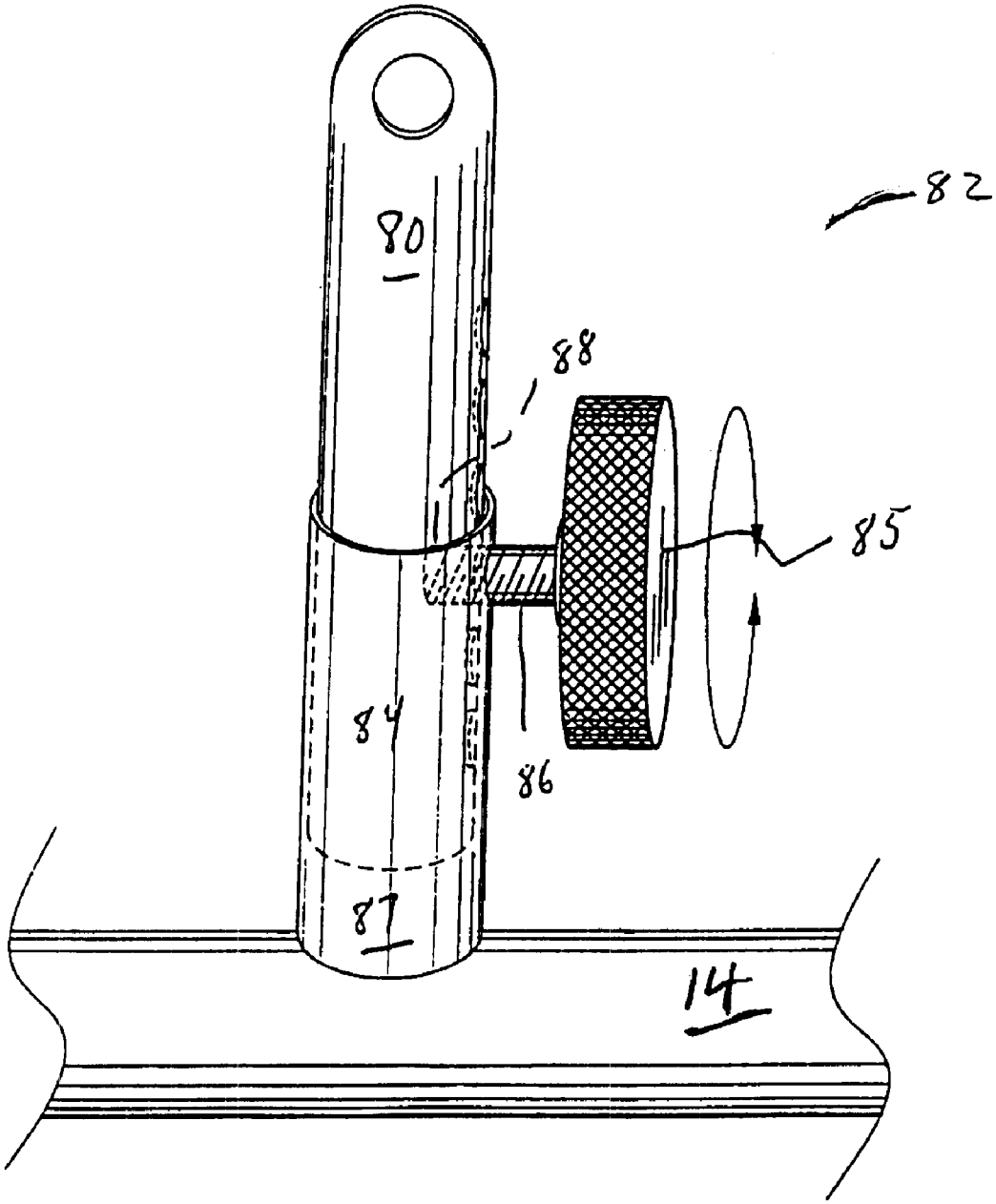
FIG. 4B is a perspective view of an adjustable back support bar and pinching hand knob mechanism used in the present invention.

As shown in FIG. 4B, the back support bar 80 is adjusted along its length via a pinching hand knob mechanism 82. A hand knob 85 is perpendicularly attached to a threaded steel bolt 86, which can be screwed into a sleeve 84 with a plurality of threaded apertures 88. The hand knob 85 can be turned to tighten and release the threaded steel bolt 86 against the support bar 80. Other special features of the combination lift mechanism and wheelchair include wherein all features are made to be automated features for the comfort and ease of use by a user.

It is to be understood that the present invention is not limited to the sole embodiment described above, but encompasses any and all embodiments within the scope of the following claims.

What is claimed is:

1. A combination lift mechanism and wheelchair for a non-ambulatory person, comprising:

a vest with a right half section and a left half section;

extensible arms for pivotally attaching each half section of the vest to the wheelchair;

a lifting means for raising and lowering an individual secured in the vest;

a support bar for supporting a back of the vest sections; and a plurality of snaps on a lower portion of the vest for attaching a canvas buttock supporter.

2. The combination of claim 1, further comprising a front securing means for securing a front of the sections of the vest, and a back securing means for securing a back of the sections of the vest.

3. The combination of claim 2, wherein the front securing means comprises a plurality of adjustable buckle fasteners.

4. The combination of claim 2, wherein the back securing means comprises a plurality of hinges permanently affixed to the back of the vest sections.

5. The combination of claim 1, wherein the support bar comprises an adjusting means for adjusting the length of the support bar.

6. The combination of claim 5, wherein the adjusting means is a pinching hand mechanism.

7. The combination of claim 1, wherein the lifting means is an adjustable cam and lever mechanism located on an arm attached to the right half vest section and an adjustable cam and lever mechanism located on an arm attached to the left half vest section.

8. The combination of claim 1, wherein the lifting means is selected from the group consisting of hydraulic actuators, pneumatic actuators, and electrical actuators.

9. The combination of claim 1, further comprising a means for controlling a temperature of the vest.

10. The combination of claim 1, wherein the vest sections comprise skeletal structural elements.

11. A method for lifting a non-ambulatory person in a wheelchair, comprising:

securing a vest to the person;

attaching supporting arms between the vest and the wheelchair;

actuating a lift mechanism to raise the height of the vest and person in the wheelchair;

supporting a back of the vest with a support bar; and adjusting the length of the support bar.

12. The method of claim 11, wherein the step of securing comprises:

attaching a right hand vest section and a left hand vest section to the person;

securing a front of the vest sections with buckles; and securing a back section of the vest sections with hinges.

13. The method of claim 11, wherein the step of actuating is selected from the group consisting of manually actuating, hydraulically actuating, pneumatically actuating, and electrically actuating.

14. The method of claim 11, further comprising controlling a temperature of the vest.

15. The method of claim 11, further comprising custom fitting an inner contour of the vest to a contour of a torso of the person.

* * * * *